US006189274B1

(12) United States Patent
Ollikainen

(10) Patent No.: US 6,189,274 B1
(45) Date of Patent: Feb. 20, 2001

(54) BUILDING HORIZONTAL STRUCTURE

(76) Inventor: Ahto Ollikainen, Kidetie 4, FIN-02460, Kantvik (FI)

( * ) Notice: Under 35 U.S.C. 154(b), the term of this patent shall be extended for 0 days.

(21) Appl. No.: 09/077,967

(22) PCT Filed: Nov. 22, 1996

(86) PCT No.: PCT/FI96/00632

§ 371 Date: Jun. 15, 1998

§ 102(e) Date: Jun. 15, 1998

(87) PCT Pub. No.: WO97/21886

PCT Pub. Date: Jun. 19, 1997

(30) Foreign Application Priority Data

Dec. 13, 1995 (FI) ..... 955961

(51) Int. Cl.[7] ..... E04B 5/14
(52) U.S. Cl. ..... 52/264; 52/403.1; 52/480
(58) Field of Search ..... 52/403.1, 167.7, 52/167.1, 167.4, 167.9, 480, 236.3, 506.01, 508, 264, 265, 289

(56) References Cited

U.S. PATENT DOCUMENTS 2,743,487 * 5/1956 Kuhlman ..... 52/480
4,854,099 * 8/1989 Kristoffersen ..... 52/480
5,581,965 * 12/1996 Jorgensen et al. ..... 52/403.1

FOREIGN PATENT DOCUMENTS

466625 * 1/1992 (EP) ..... 52/480
767152 * 7/1934 (FR) ..... 52/480
WO 91/19064 12/1991 (WO) ..... E04F/15/20

OTHER PUBLICATIONS

Svensk Byggtjanst, Svensk Byggkatalog, okt –94, Hafte 25, sid 21, "Varnamo Stomljudsisoleringslist".

* cited by examiner

*Primary Examiner*—Michael Safavi
(74) *Attorney, Agent, or Firm*—Pollock, Vande Sande & Amernick, RLLP

(57) ABSTRACT

A horizontal support structure for a building area divided into sub-areas. The structure comprises a primary support system of girders arranged spaced apart and parallel to each other. A secondary support system of joists is arranged essentially cross-wise on top of the primary support system. The joists are selectively supported on the girders such that joists under different sub-areas are supported by different girders.

3 Claims, 2 Drawing Sheets

BUILDING HORIZONTAL STRUCTURE

FIELD OF THE INVENTION

The present invention relates to a horizontal frame structure for a building, the structure being based on floor joists/beams which are placed over the area supported by the horizontal frame structure and arranged into a single- or multi-layer staggered array. The horizontal frame structure can be used in a ground floor, party floor or top-level floor. The horizontal frame structure according to the invention facilitates the division of the area or space supported by the horizontal frame structure into subareas or segregated spaces which are effectively insulated from each other against flanking transmission of sound.

The present horizontal frame structure is particularly intended for use in lightweight buildings for the purpose of preventing flanking transmission of sound via structural elements between the spaces supported by the present horizontal frame structure. While the present invention is primarily intended for use in timber buildings, the invention may also be adapted to frame structures implemented by means of other materials.

BACKGROUND OF THE INVENTION

Transmission of structurally propagated sound called flanking transmission between the different areas or spaces of a building is a problem particularly in buildings erected with lightweight materials lacking such inertial masses that normally provide sound insulation. Conventionally, insulation against flanking transmission between segregated spaces of a single storey in a lightweight building has been implemented by providing each space to be sound-insulated with an unconnected vertical frame structure to which the load-bearing floor joists of each isolated space are then supported. Such a bordering principle of sound-insulated spaces based on unconnected vertical frame structures makes the space reservations of superimposed spaces dependent on each other and destroys the flexibility of space layout.

Furthermore, such a sound-insulating frame structure raises a need for an essentially overdimensioned foundation with respect to the overall weight of the building, since the support structures of the building's vertical frame are erected at points determined by the structural grid of the sound-insulated spaces onto the building's square area footprint, and each load-bearing column requires a separate load-receiving reinforcement in the building's foundation.

SUMMARY OF THE INVENTION

It is an object of the present invention to overcome the above-described drawbacks by virtue of the horizontal frame structure according to the invention. A particular benefit of the invention is that it permits independent layout of the sound-insulated areas and spaces partitioned over the area of the present horizontal frame structure regardless of the location of the supporting structures. This same freedom in the location of structures applies to both the spaces on the same level with the horizontal frame structure and those located thereabove and thereunder. The horizontal frame structure according to the invention facilitates the use of a simple frame structure, wherein the factors affecting the location of the vertical frame members are rationally based on the load-bearing capability of vertical frame building elements rather than on the need for sound insulation.

BRIEF DESCRIPTION OF THE DRAWINGS

In the following the invention is described in greater detail with reference to annexed diagrammatic drawings in which.

DETAILED DESCRIPTION OF THE INVENTION

Figure 1:
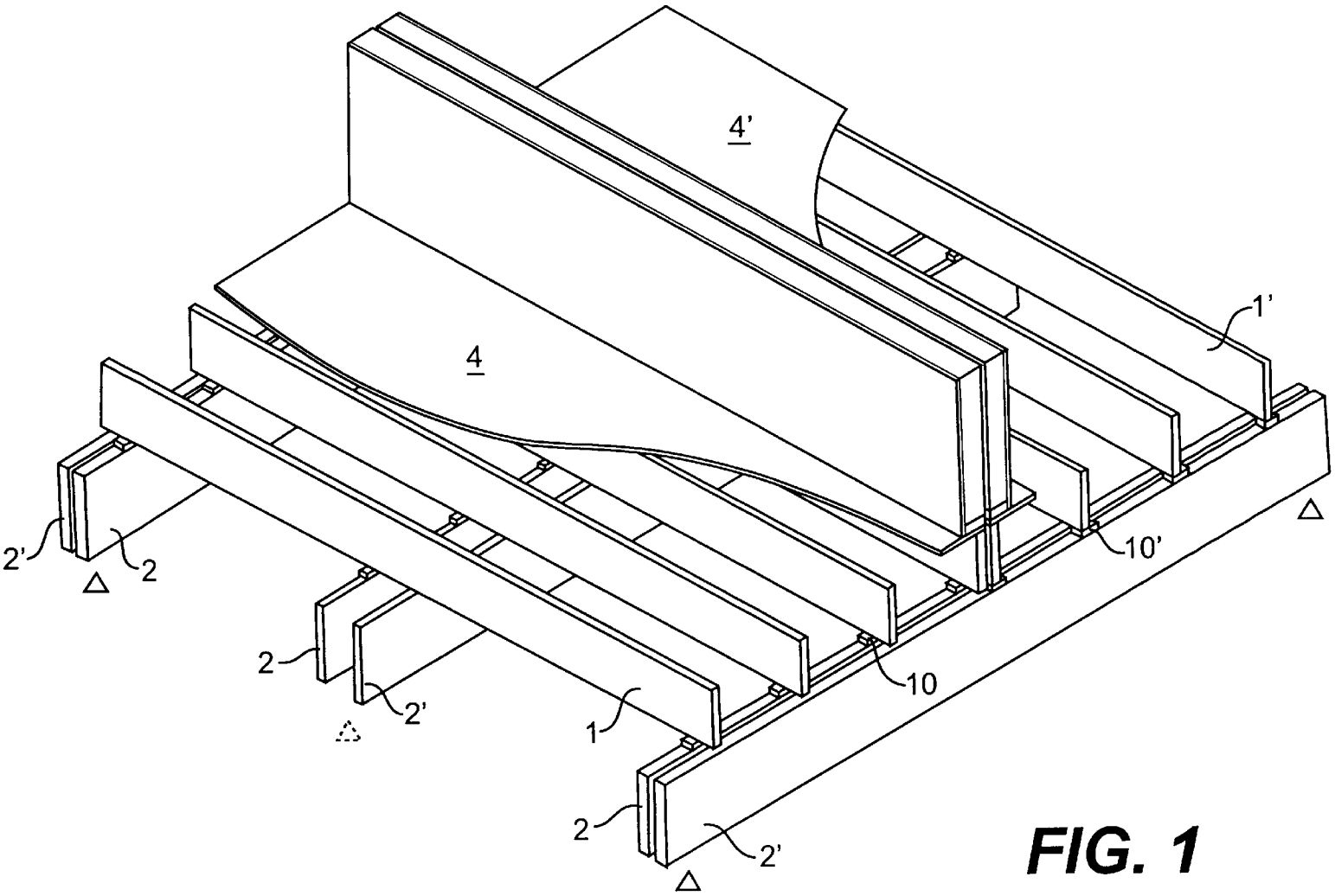
FIG. 1 shows a basic embodiment of the invention.

Referring to FIG. 1, therein is shown diagrammatically a sectional view of a building party floor illustrating an exemplifying embodiment of the principle of the invention.

The party floor comprises load-bearing joists 1 and 1' which are spaced over the party floor area according to a structural grid based on the load-bearing capacity required from the floor. The span of the joists in the party floor can be, e.g., a full modular length of the building frame or, for a larger building, the party floor joists can be provided with intermediate supports to limit the unsupported span of the joists to reasonable lengths. The supporting of the party floor joists is accomplished by girders 2 and 2', which further are supported by the vertical frame. According to the basic concept of the invention, each of the girders 2, 2' supports only one of the areas 4 and 4', or alternatively, only one of the spaces which are bordered by these areas and are intended to be sound-insulated from each other against flanking transmission.

Supporting with isolation against flanking transmission separately for each area can be implemented at each load-supporting point by virtue of spacers 10, 10' placed in a staggered manner over the girders 2, 2', whereby the spacers are located so that one sound-insulated area 4 is supported by one girder-group 2 only, while the other sound insulated area 4' is supported by the other girder-group 2' alone.

Figure 2:
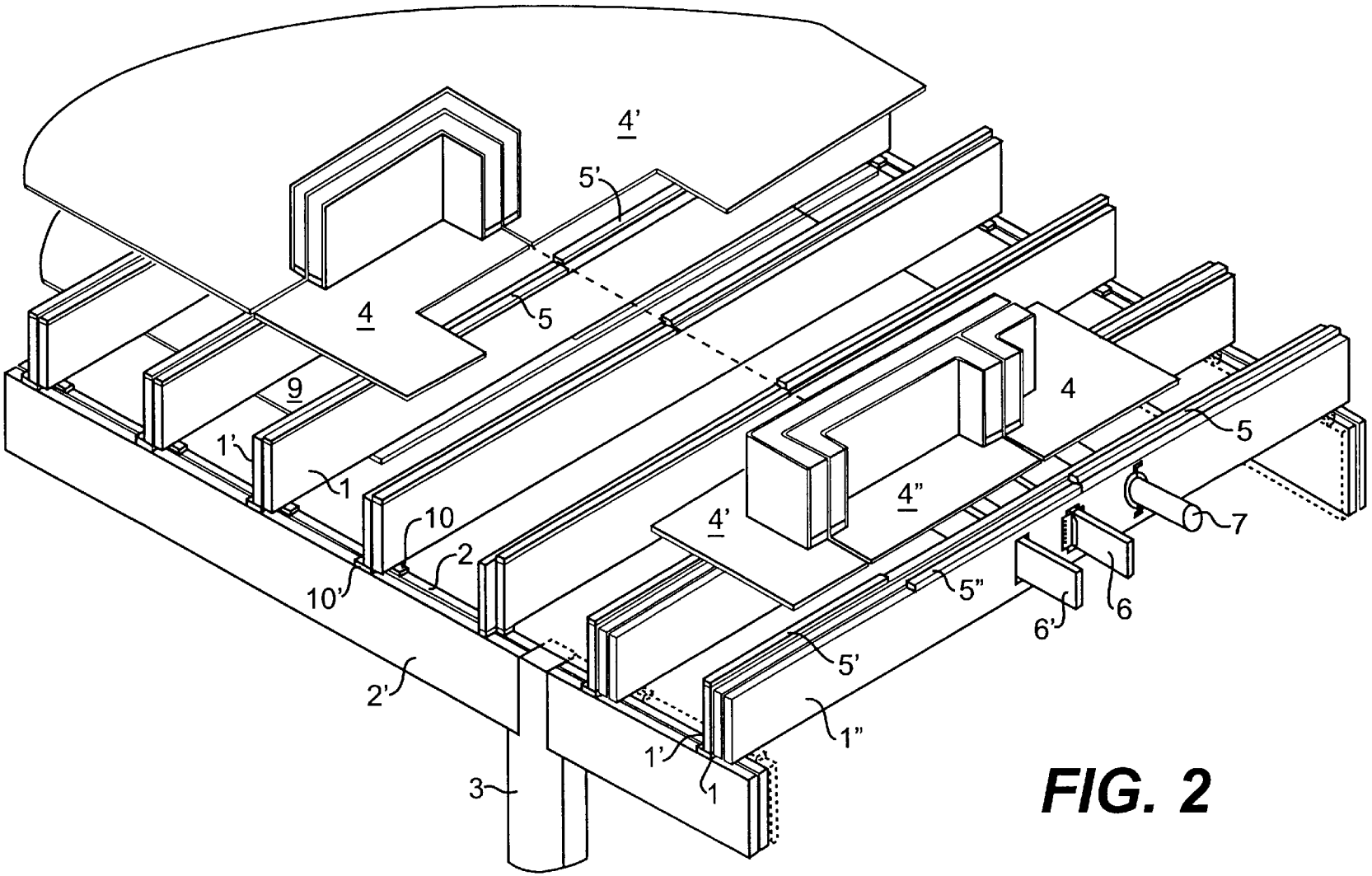
FIG. 2 shows alternative embodiments of the invention.

In the embodiment shown in FIG. 2, an alternative implementation of the invention is shown in which the isolated supporting of areas 4, 4', which are sound-insulated against flanking transmission, is accomplished by means of floor joists 1, 1' and 1" acting primarily as secondary supports. In the embodiment shown herein, to each load-bearing point are adapted two or three parallel joists, which are isolated from each other, whereby the number of joists is determined how many sound-insulated areas or spaces partitioned above are desired to be supported by the load-bearing point. The staggered support for each area separately is achieved by means of spacers 5, 5' and 5", which are appropriately placed between the floor areas 4, 4' and 4", respectively, and each selected floor joist so as to isolate the supported floor from the adjacent joist(s) intended to support other area(s).

The party floor joists 1, 1' and 1", which are depicted as conventional lumber joists in the above-described exemplifying embodiment of the invention, may as well be selected from the group of gluelam, laminated veneer lumber or lattice beams manufactured in a conventional manner. Also different types of hollow-core beams are suitable for use within the scope of the invention. The invention may also be implemented in a horizontal loadbearing structure based on load-bearing slabs. Obviously, the slabs must be dimensioned with respect to the overall area of the horizontal frame structure so that the supporting of the isolated subareas can be borne by slabs of reasonable dimensions. In practice, such slabs can be relatively narrow hollow-core or ribbed slabs.

In a horizontal frame structure implemented according to the invention, the spans of the joists may be relatively long. Resultingly, lateral vibrations may occur in the horizontal elements. The simplest method of suppressing lateral vibrations is to make the joists into wide box-section elements. Also the above-mentioned slab structure can suppress the lateral vibrations. In cases here these structures are considered unpracticable, it may be necessary to connect the joists of each isolated subarray to each other laterally. When such a lateral bracing of joists spanned between a greater number of load-bearing points is implemented, it is essential to pass the bracing beam so that it will be connected to the joists of a single sound-insulating subarray while passing without contact through the joists belonging to the other subarray(s).

Analogously, piping/ducts passed through the joists such as air-conditioning, heating, water, sewer and electrical ducts must be isolated from the joists in either a noncontacting or sound-insulating manner.

The connection of the joists to the areas supported by them can be made in the above-described manner by means of spacers which are placed on the joist thus transmitting the load of the supported area in a supporting manner to the joist. In the simplest way this can be accomplished as shown in the diagram by means of spacer pieces 5, 5' and 5", which are fixed onto the joists. The purpose of the spacer is to outdistance the structural elements serving to isolate the structures of a certain sound-insulated area from the joists serving to support the other sound-insulated areas, whereby an isolating gap against flanking transmission is created between the joist(s) carrying the spacer(s) and the other structural elements connected to the "other" supported areas.

The embodiments shown in the diagrams are related to a building party floor structure in which the structures partitioning the areas above the structure are supported to a floor structure, which is further supported from below by separate joists selected by appropriately placed spacers. The diagram of FIG. 2 also shows the party ceiling 9 of the next storey below that may in an analogous manner be supported in sound-insulated areas hung by isolated groups of supports in the same manner as the party floor above. Further analogously, the same isolation principle can be applied to the other structures of the space below that are connected to the joists of the overlying floor.

The party floor structure according to the invention allows relatively free layout of spaces sound-insulated from each other over the area of the party floor, whereby the other structures used to partition the spaces must be designed with due caution as regards the isolation of flanking transmission by conventional means. Further, the invention makes it possible to isolate a certain subarea within a certain area isolated against flanking transmission in, e.g., a flat or apartment space. An example of such an embodiment is the floor support of the washing machine space which can be isolated from the floor support of the other areas of the flat.

What is claimed is:

1. A horizontal support structure for a building area divided into at least two sub-areas, the structure comprising:

a primary system of parallel girders arranged in at least two sub-systems extending over the building area; and a secondary support system of joists arranged perpendicularly on top of the primary support system and arranged in sub-systems, wherein the joists in each sub-system rest on only girders in one of the at least two primary sub-systems and support only one of the at least two sub-areas a number of flooring substrates each of which is supported by a separate secondary support sub-system of joists; and a wall upstanding from the flooring substrates serving to separate the at least two sub-areas one from another.

2. A horizontal support structure as defined in claim 1, wherein spacers between the girders and joists define a joist sub-system.

3. A horizontal support system as defined in claim 1, wherein spacers between the joists and a sub-area define a joist sub-system.

* * * * *